US005257591A

United States Patent [19]

Suzuki et al.

[11] Patent Number: 5,257,591

[45] Date of Patent: Nov. 2, 1993

[54] AUTOMATIC SEWING APPARATUS FOR HEMMING AND CLOSING SLEEVE

[75] Inventors: Yukinori Suzuki, Toyohashi; Hayami Kawamoto, Suita; Tatsuaki Kaneda, Nishinomiya; Masahiko Nishikawa, Suita, all of Japan

[73] Assignee: Pegasus Sewing Machine Mfg., Co., Ltd., Osaka, Japan

[21] Appl. No.: 851,931

[22] Filed: Mar. 16, 1992

[30] Foreign Application Priority Data

Jul. 26, 1991 [JP] Japan ..... 3-187704

[51] Int. Cl.[5] ..... D05B 21/00; D05B 35/02; D05B 27/00

[52] U.S. Cl. ..... 112/121.12; 112/304; 112/121.15; 112/141; 112/147; 112/155

[58] Field of Search ..... 112/303, 304, 306, 320, 112/10, 272, 121.12, 121.15, 262.3, 155, 262.2, 262.1, 141, 147, DIG. 2, 121.11

[56] References Cited

U.S. PATENT DOCUMENTS

| | | | |
|---|---|---|---|
| 3,192,885 | 8/1961 | Timm | 112/2 |
| 3,886,877 | 6/1975 | Akaishi et al. | 112/DIG. 2 X |
| 4,214,541 | 2/1977 | Zeigler et al. | 112/262.3 |
| 4,428,315 | 1/1984 | Keeton | 112/262.3 |
| 4,621,585 | 11/1986 | Ball et al. | 112/10 |
| 4,624,198 | 11/1986 | Beam et al. | 112/10 |
| 4,754,717 | 7/1988 | Henze et al. | 112/121.12 X |
| 4,784,381 | 11/1988 | Prochut et al. | 112/10 X |
| 4,800,830 | 3/1988 | Adamski et al. | 112/303 |
| 4,934,293 | 12/1988 | Yokota et al. | 112/288 |
| 5,044,289 | 9/1991 | Keeton | 112/141 X |

*Primary Examiner*—Clifford D. Crowder
*Assistant Examiner*—Paul C. Lewis
*Attorney, Agent, or Firm*—Jones, Tullar & Cooper

[57] ABSTRACT

An automatic sewing apparatus for hemming and closing a sleeve is used for hemming a sleeve blank and sewing it into tubular form for making, for example, a short-sleeved T-shirt. The steps subsequent to putting the sleeve blank on a conveyor are done fully automatically and continuously to make the tubular sleeve. The apparatus according to one embodiment of the invention comprises first and second sewing machines disposed at inner corner sides of an L-shaped sewing table, a feed device having a conveying surface disposed on a table part of the first sewing machine side of the sewing table, a folding member for folding the blank edge along the feed direction, a deflecting device having a member for stopping the running of the front end of the hemmed piece above the conveying surface, and a transfer device for feeding the deflected piece of a hemmed sleeve blank to the second sewing machine.

4 Claims, 7 Drawing Sheets

AUTOMATIC SEWING APPARATUS FOR HEMMING AND CLOSING SLEEVE

BACKGROUND OF THE INVENTION

1. Field of the Invention

The present invention relates to an automatic sewing apparatus for hemming and closing a sleeve. The apparatus is used in automatically making a tubular sleeve from a sleeve blank by sewing machines.

The apparatus for making a sleeve, such as making a short sleeve of a T-shirt, requires a device for hemming along the folded line by folding an edge of the sleeve blank in an S-form, a sewing machine for hemming the blank along the folded line, a device for folding in two the hemmed piece along a line orthogonal to the hemming line, that is, folding in halves, and another sewing machine for closing in a tubular form by sewing the edges of the folded piece together.

2. Description of the Prior Art

In the sleeve making apparatus comprising the noted devices, generally hitherto, each device was mutually separated and the sleeve making process with the apparatus is separated into steps according to the devices. That is, one operator hems with a sewing machine, and the hemmed piece once it is taken out of the sewing machine, is manually folded in halves by another operator, and the folded piece is fed into another sewing machine by another operator, then the edges of the folded blank are sewn together.

In the sleeve making process with the steps separated in such a manner, an assembly line requiring many operations is generally formed in order to improve productivity. Even in the assembly line, a waiting time between consecutive steps is likely to occur, and overall job efficiency is, consequently, not so high. Therefore, the product cost is increased and working space for folding the blank is needed aside from the space for installing two sewing machines. Overall, a large working space is required.

Contrary to the manual procedure not above U.S. Pat. No. 4,428,315 discloses a fully automated assembly for a sleeve making apparatus. In the disclosed assembly, by raising the pickup head engaged with the center line of the back side of the sleeve blank, the sleeve blank is folded in two in the vertical plane, and the free edges of the two-fold blank are put on a conveyor to convey the blank along a folding line direction, then the blank is drawn out of a pickup head and folded in halves.

The assembly disclosed in the U.S. Pat. No. 4,428,315 is a fully automatic sleeve making apparatus, and it saves labor and installation space, improves efficiency, and lowers product cost. In such an automatic sewing apparatus, however, the blank fold apparatus is very complicated, and it is necessary to pick up the entire blank to fold in two, and draw out the folded blank while sliding on the pickup head, and therefore if the blank is, for example, slippery, it is hard to fold neatly in halves, and if folded neatly, it is often deviated when drawing out from the pickup head, and finally a neatly folded blank is not obtained and it is very difficult to make the tubular sleeve as intended.

SUMMARY OF THE INVENTION

It is hence a primary object of the present invention to provide an automatic sewing apparatus for hemming and closing a sleeve capable of making a tubular sleeve fully automatically and continuously after only putting a sleeve blank on a conveyor, thereby saving labor and space, enhancing productivity, reducing product cost, and also exhibiting a blank folding function as intended in spite of a simple structure.

It is another object of the present invention to fold the blank securely and accurately regardless of the material or properties of the sleeve blank.

To achieve the above stated objects, the present invention provides an automatic sewing apparatus for hemming and closing a sleeve comprising a sewing machine table having an L-shaped blank mounting surface, a first sewing machine for making a hemmed piece and a second sewing machine for forming a tubular sleeve from the hemmed piece installed at each inner side on the sewing table and a blank feed device having a conveying surface on a same plane as the sewing table nearly over the whole length of the table of the first sewing machine side.

The automatic sewing apparatus further comprises a folding device before hemming, a deflecting device for folding the hemmed piece crossing a hemming line, a transfer device for a hemmed and folded piece, and sensors for detecting the hemmed piece running on the conveying surface.

The folding device is installed on the conveying surface of the feed device before the first sewing machine, therefore the folding device folds back an edge of the opening side of the sleeve of the blank along the running direction so that the edge may be sewn to the lower side of the blank by the first sewing machine.

The deflecting device, installed at a delivery side of the first sewing machine, comprises an elevating member and a clamping member, deflects the hemmed piece to fold it in half along a line orthogonal to the hemming line.

On a signal from one of the sensor detecting a front end of the hemmed piece, the elevating member raises the front end of the hemmed piece to an upper position from the conveying surface, and the clamping member stops the running of the front end of the hemmed piece at the upper position by gripping the front end. On a signal from a sensor detecting the rear end of the piece, the clamping member releases the front end to have it fall down on the rear end of the running hemmed piece, and the hemmed piece is deflected neatly.

The transfer device transfers the hemmed and deflected piece in a direction orthogonal to the feed direction of the feed device along the upper surface of the table of the second sewing machine side and feeding the edge portion into the second sewing machine, wherein a tubular sleeve is formed by sewing together the edges of the hemmed and folded piece through the second sewing machine.

Meanwhile, in the hemming step by the first sewing machine, when an edge of the blank is folded in an S-form so that it may come to the upper side, air may be blown toward the inside of the folding portion of the blank after hemming, or a wire or other shielding object contacting the upper surface of the blank may be disposed to cross obliquely above the sewing line, and therefore the folding portion is developed flat so that the edge may come to the lower side of the blank.

According to the present invention so constructed, the tubular sleeve making operation can be done fully automatically and continuously. That is, by putting the sleeve blank on the conveying surface and moving the blank feed device, the edge of the blank is folded along the blank running direction, and is hemmed along the folding line by the first sewing machine to make a hemmed piece. The hemmed piece is successively fed into the deflecting device, in which the piece is deflected to make a folded piece, folded in a half width along the line orthogonal to the hemming line, and the folded piece conveyed to the conveying end part of the blank feed device is transferred in the orthogonal direction by the transfer device. Then, the edges are fed into the second sewing machine, and the edges of the folded piece is sewn together. As a result, the labor of making a sleeve is saved, productivity is enhanced, the product cost is lowered, and the space of the entire apparatus is saved. Besides, with the present invention, the process of folding in a half width is done by a series of steps including the steps of clamping and lifting the front end of the hemmed piece at a specified time, and a releasing step at a specified time, and therefore, the deflecting can be done more securely and accurately as compared with the conventional deflecting method of picking up the entire piece and folding it in two.

In the present invention, a blank feed device may comprise several conveyor belts installed parallel at proper intervals in the direction orthogonal to the blank feed direction, a deflecting device may comprise a clamp having a plurality of tongues disposed at each adjacent interval of the conveyor belts, opening and closing vertically to the upstream side of the conveyor belts, for holding and releasing the front end side of the hemmed piece conveyed on the conveyor belt, a driving mechanism may be used for elevating the clamp to an upper position from a hemmed piece holding position, and a sensor may be used for detecting when the rear end of the hemmed piece reaches the specified position and issuing a signal for canceling the holding state. In such an arrangement, the deflecting process may be carried out by clamping only the front end portion and lifting while conveying the hemmed piece on the conveyor belt, and releasing it on receiving the signal from the sensor. The hemmed piece may be deflected in half within the horizontal plane only by elevating and lowering without inverting the clamp, and the conveyor belts may be driven continuously without stopping. Therefore, the entire structure of the deflecting device may be simplified, and the deflecting operation may be done efficiently, and, regardless of the material and properties of the blank, the deflecting function may be securely and accurately exhibited, so that the sleeve may be fabricated at a high yield.

The other features and effects of the invention will be better understood and appreciated from the following detailed description of the embodiment given in conjunction with the accompanying drawings.

DETAILED DESCRIPTION OF THE PREFERRED EMBODIMENT

Figure 1:
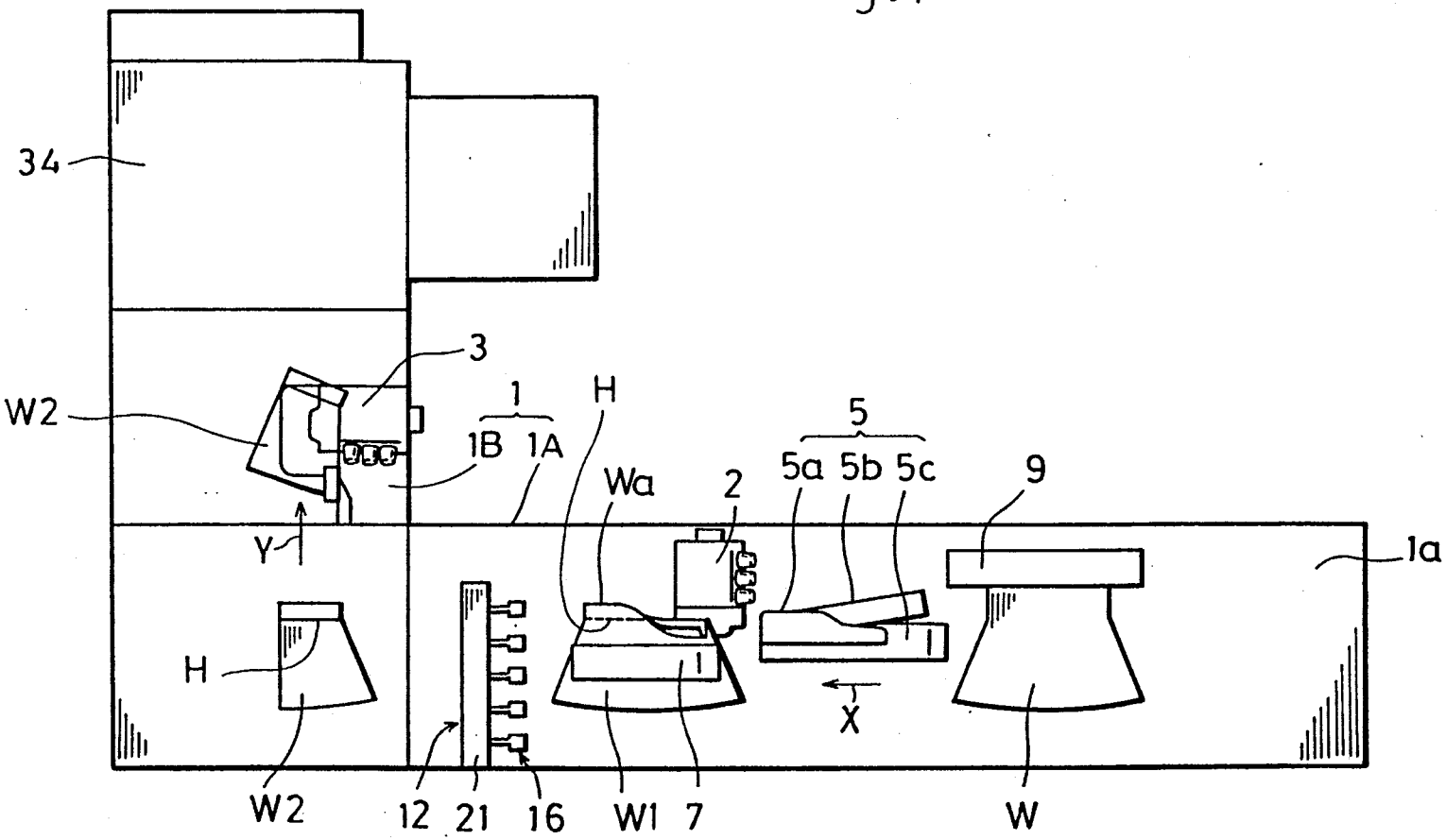
FIG. 1 is a plan view showing a general view of an automatic sewing apparatus for hemming and closing a sleeve in an embodiment of the present invention.
Figure 2:
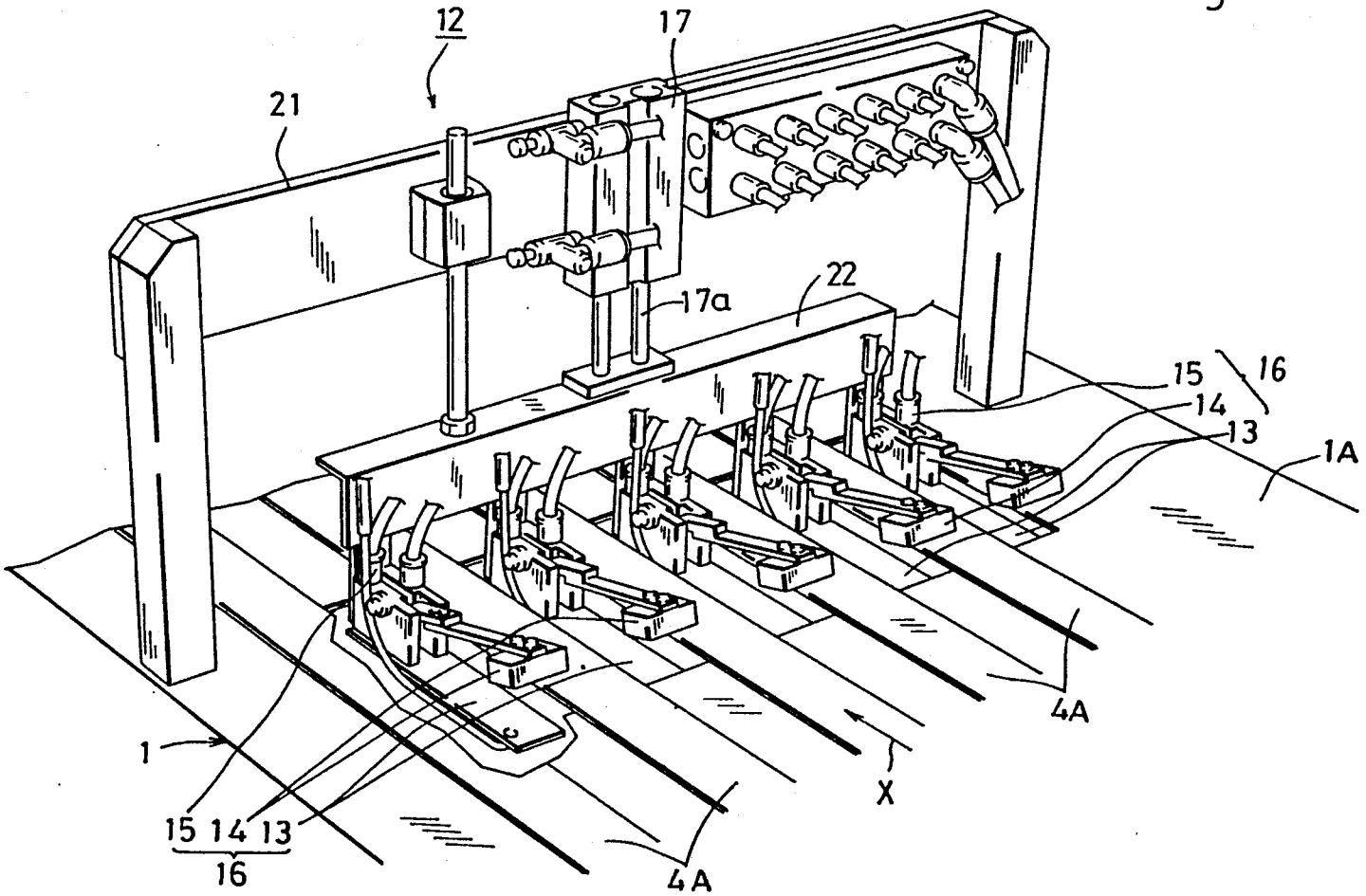
FIG. 2 is a partially cut-away magnified perspective view showing the structure of a blank deflecting device.

FIG. 1 is a plan view showing schematically a general structure of an automatic sewing apparatus for hemming and closing a sleeve, in which numeral 1 is a sewing machine table having parts 1A and 1B and an L-shaped blank mounting plane 1*a*. A first sewing machine 2 and a second sewing machine 3 are installed at first and second inner corner sides respectively, of this sewing machine table 1. On the blank mounting plane 1*a* of the table part 1A of the first sewing machine 2 side of the sewing machine table 1, several narrow first conveyor belts 4A of a blank feed device 4 are disposed parallel and at proper intervals in the direction orthogonal to the blank feeding direction before and after the first sewing machine 2 as shown in FIG. 2 through FIG. 6. Several narrow second conveyor belts 4B having their conveying surface flush to the surface of the first conveyor belts 4A and in the same conveying direction are disposed parallel and continuous to the conveying end portion of each first conveyor belt 4A. The blank feed device 4 is composed of these first conveyor belts 4A and second conveyor belts 4B, which run nearly the overall length of the table part 1A.

Figure 3:
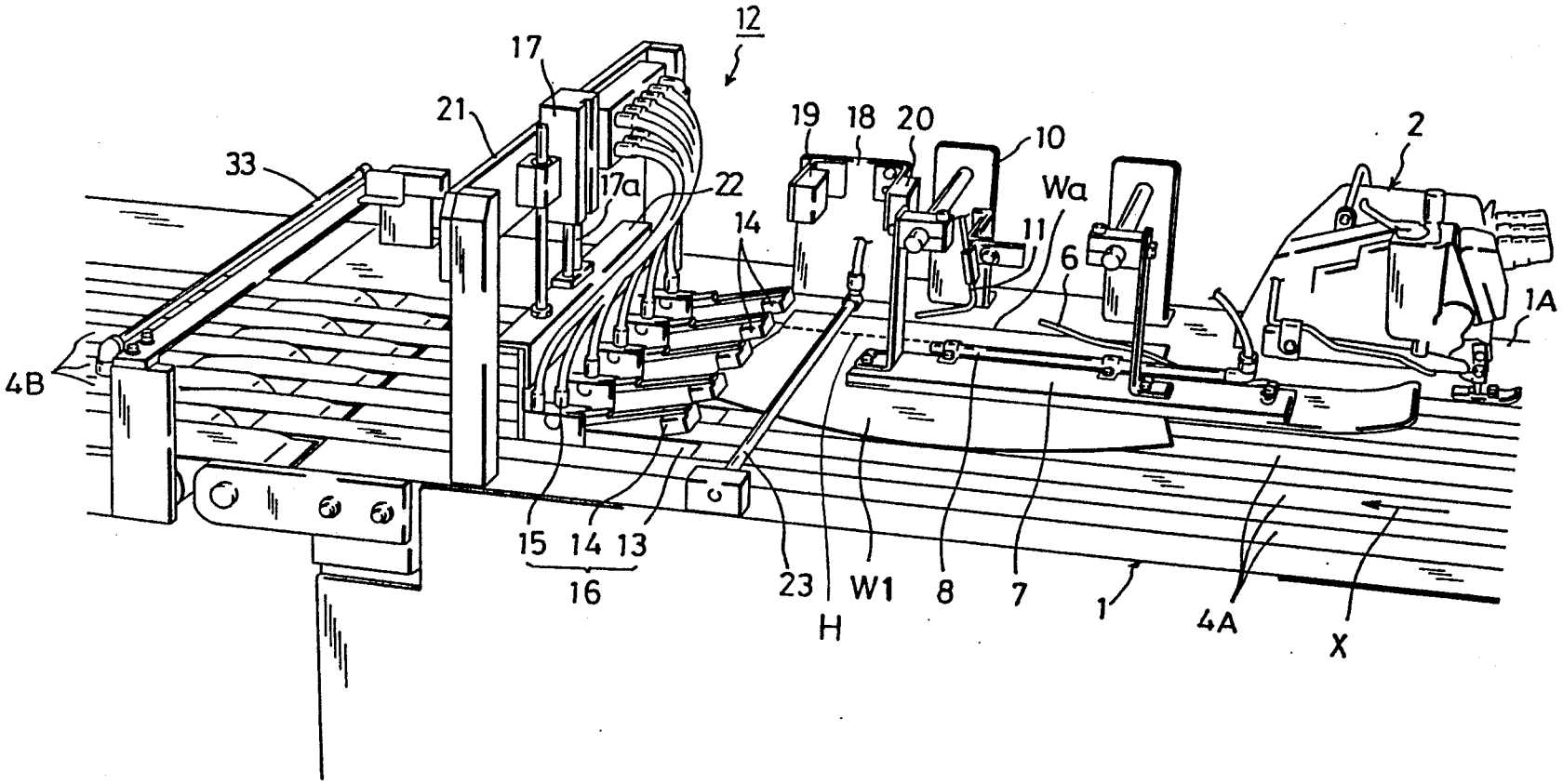
FIG. 3 is a perspective view showing the structure and operation from a first sewing machine to the deflecting device through a hemmed piece flattening tool.

On the conveying surface of the first conveyor belts 4A, a folding device 5 is disposed before the first sewing machine 2. The folding device 5 is intended to fold an edge of a sleeve blank W in the shape as shown in FIG. 1. The sleeve blank is mounted along a fitting guide 9 on the conveying surface of the first conveyor belts 4A along its edge, and shaped into an S-form by means of three laminated plate members 5*a*, 5*b*, 5*c*. By feeding the blank W to pass through this folding device 5 to the first sewing machine 2, the S-formed folding edge is hemmed along the folding line. On the conveying surface of the first conveyor belts 4A, at the delivery side of the first sewing machine 2, a bar-shaped flattening tool 6 is installed (FIG. 3). The flattening tool 6 has one end fixed on a holding plate 7 for pressing down the hemmed piece W1 delivered from the first sewing machine 2 on the first conveyor belt 4A as shown in FIG. 3, and the other end of the tool 6 projects obliquely across the hemming line H in the feed direction X of the blank W, and as shown in FIGS. 7A to 7D, the S-formed folding part Wa of the hemmed piece W1 is sequentially developed flatly along with the conveyance of the hemmed piece W1 so that the edge of the blank W may be at the lower side of hemmed piece W1 itself.

Along one edge in the widthwise direction of the holding plate 7, an air blow pipe 8 is fixed, and another air blow pipe 11 is supported on a bracket 10 fixed on one end in the widthwise direction of the table part 1A corresponding to the front end part of the air blow pipe 8. On the peripheral walls of these air blow pipes 8 and 11, as indicated by arrows in FIG. 7B to FIG. 7D, nozzle holes 8A and 11A for blowing air toward the S-formed folding part Wa of the hemmed piece W1 are formed, and flattening of the piece W1 is assisted by the air blown from these nozzle holes 8A and 11A, when flattening and developing the S-formed folding part Wa of the hemmed piece W1 by the flattening tool 6.

A deflecting device 12 for folding the hemmed piece W1 in halves along the line orthogonal to the hemming line H, after passing through the flattening tool 6, is provided. The deflecting device 12 comprises an air cylinder 17 and plural clamps 16 each having a fixed tongue 13, a movable tongue 14 and an air cylinder 15 as shown in FIG. 2 to FIG. 5. The fixed tongue 13 is disposed between adjacent conveyor belts 4A and 4A, and the movable tongue 14 opposite to these fixed tongue 13, each of which is arranged to be driven to open and close vertically by the air cylinder 15 toward the upstream side of the conveyor belts 4A. Each clamp 16 is free to hold and release the front end portion of the hemmed piece W1 conveyed on the conveyor belts 4A. The air cylinder 17 is installed as a driving mechanism for elevating and lowering all the clamps 16 between the holding position of the hemmed piece W1 shown in FIG. 3 and the upper position shown in FIG. 4 and FIG. 5. First and second sensors 19, 20 are mounted spaced apart on a bracket 18 in the feeding direction X for the blank and hemmed piece so as to detect the presence or absence of the piece W1 conveyed on the conveyor belts 4A.

Figure 4:
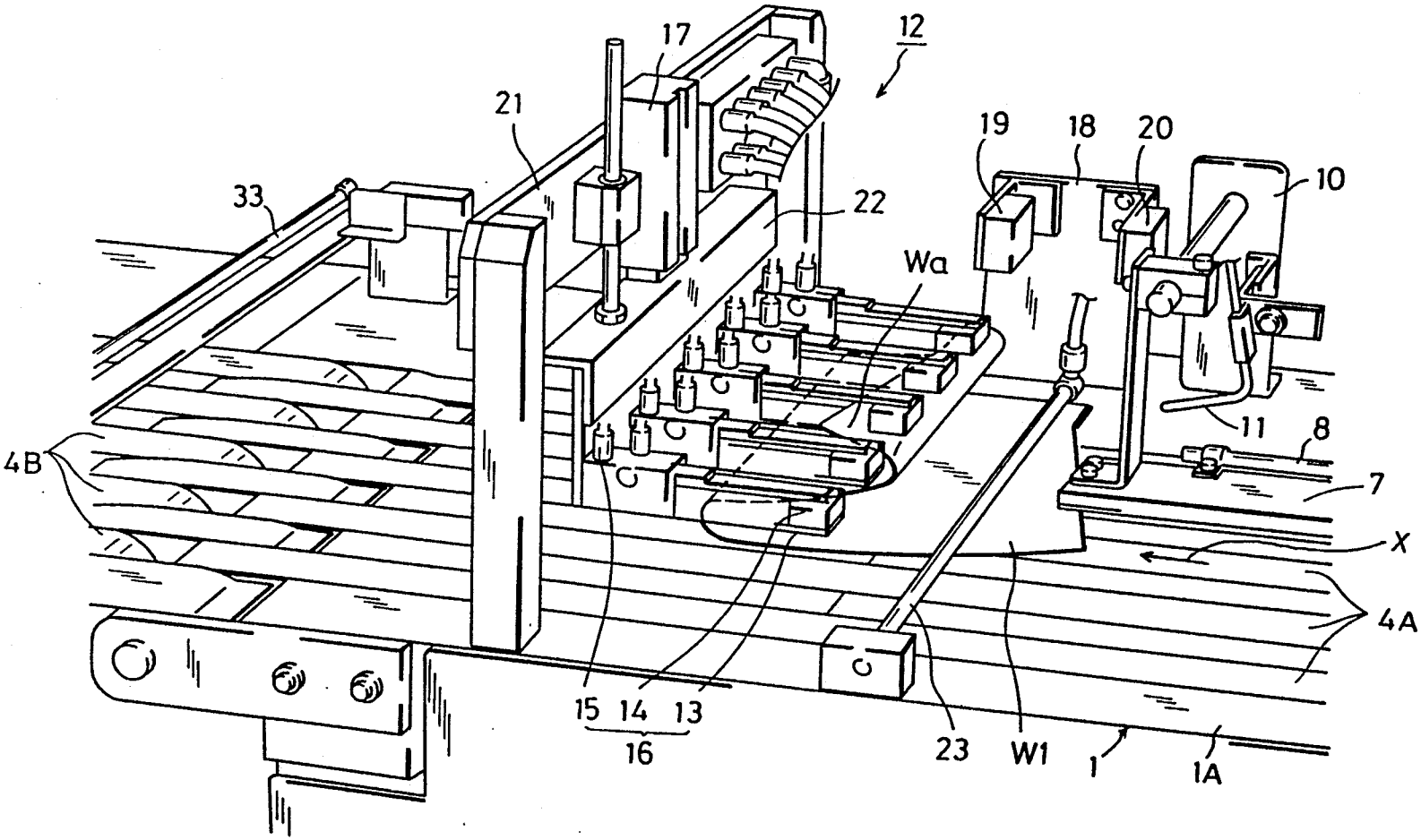
FIG. 4 is a perspective view of essential parts showing the state of holding and lifting the front end portion of the hemmed piece by the deflecting device.
Figure 5:
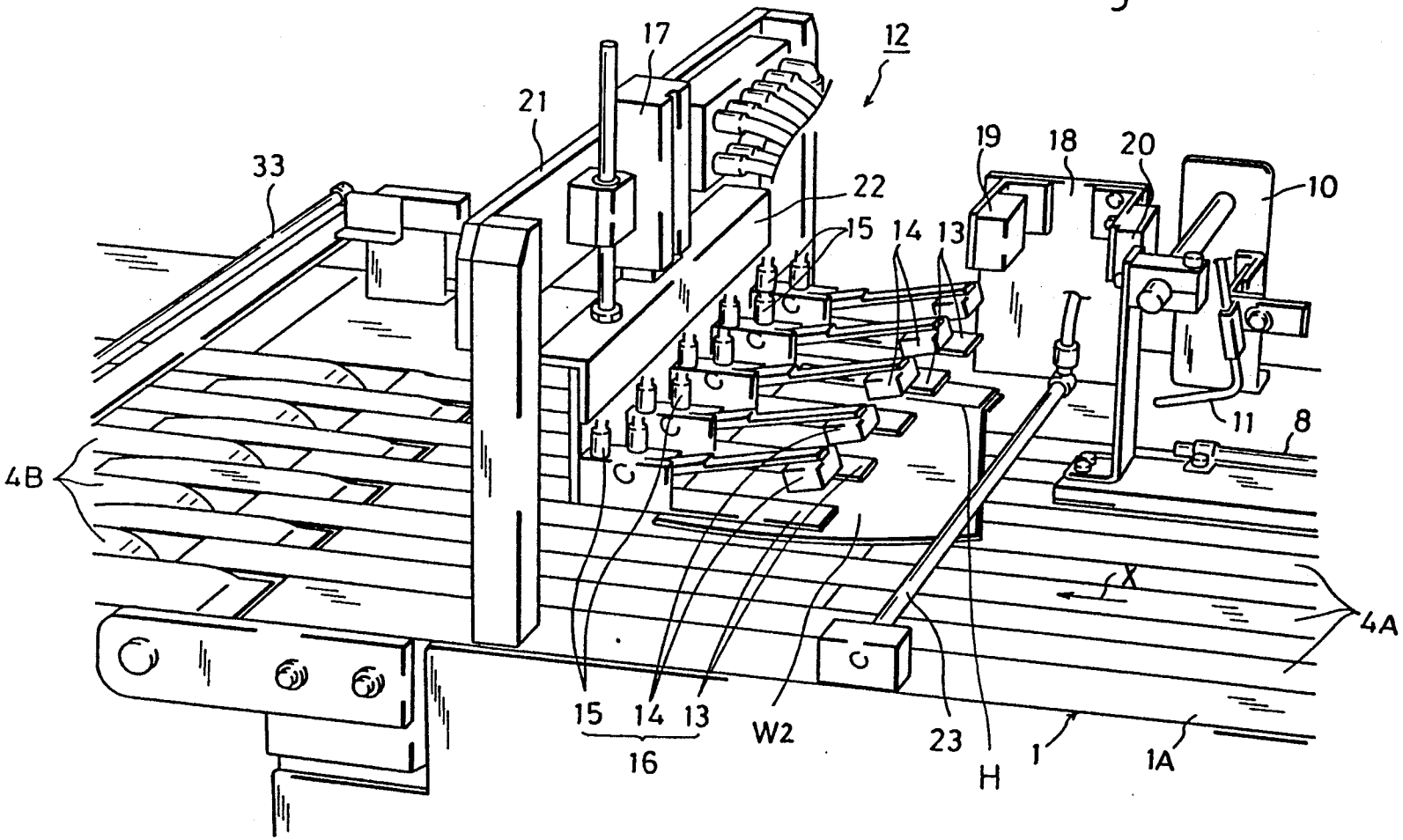
FIG. 5 is a perspective view of essential parts showing the state right after deflecting the hemmed piece in halves by the deflecting device.

The air cylinder 17 is fixed in the middle part of the portal frame 21 set up on the sewing machine table 1, and at the lower end of the piston rod 17*a* of the air cylinder 17 is fixed and linked a support frame 22 for the clamp 16. The first sensor 19 and second sensor 20 are designed to detect whether the piece W1 conveyed on the conveyor belts 4A is present at the specified position or not, and if so to issue a detection signal. By the operation of the air cylinder 15, which responds to the detected signal both tongues 13, 14 of the clamp 16 are closed to hold the front end part of the hemmed piece W1, and by actuation of the air cylinder 17, the clamp 16 and the front end part of the hemmed piece W1 are lifted above the conveying surface of the conveyor belts 4A to be stopped in the state shown in FIG. 4. Besides, in the holding and lifting state the front end part as shown in FIG. 4, the rear end part of the hemmed piece W1 is conveyed continuously by the conveyor belts 4A, and when the second blank sensor 20 detects the absence of the hemmed piece W1, it is known that the rear end part has passed, and a signal is issued accordingly. On the basis of this detected output signal, and the operation of the cylinders 15, both tongues 13, 14 of the clamp 16 are opened, and holding of the front end part of the hemmed piece W1 is canceled, so that the front end part is spontaneously lowered onto the rear end part so that the hemmed piece W1 is deflected or folded in half along the line orthogonal to the hemming line H. In FIG. 3 to FIG. 5, an air blow pipe 23 is shown for blowing air toward the hemmed piece W1 lifted with the front end part held by the clamps 16, and assisting the folding of the hemmed piece W1.

Figure 6:
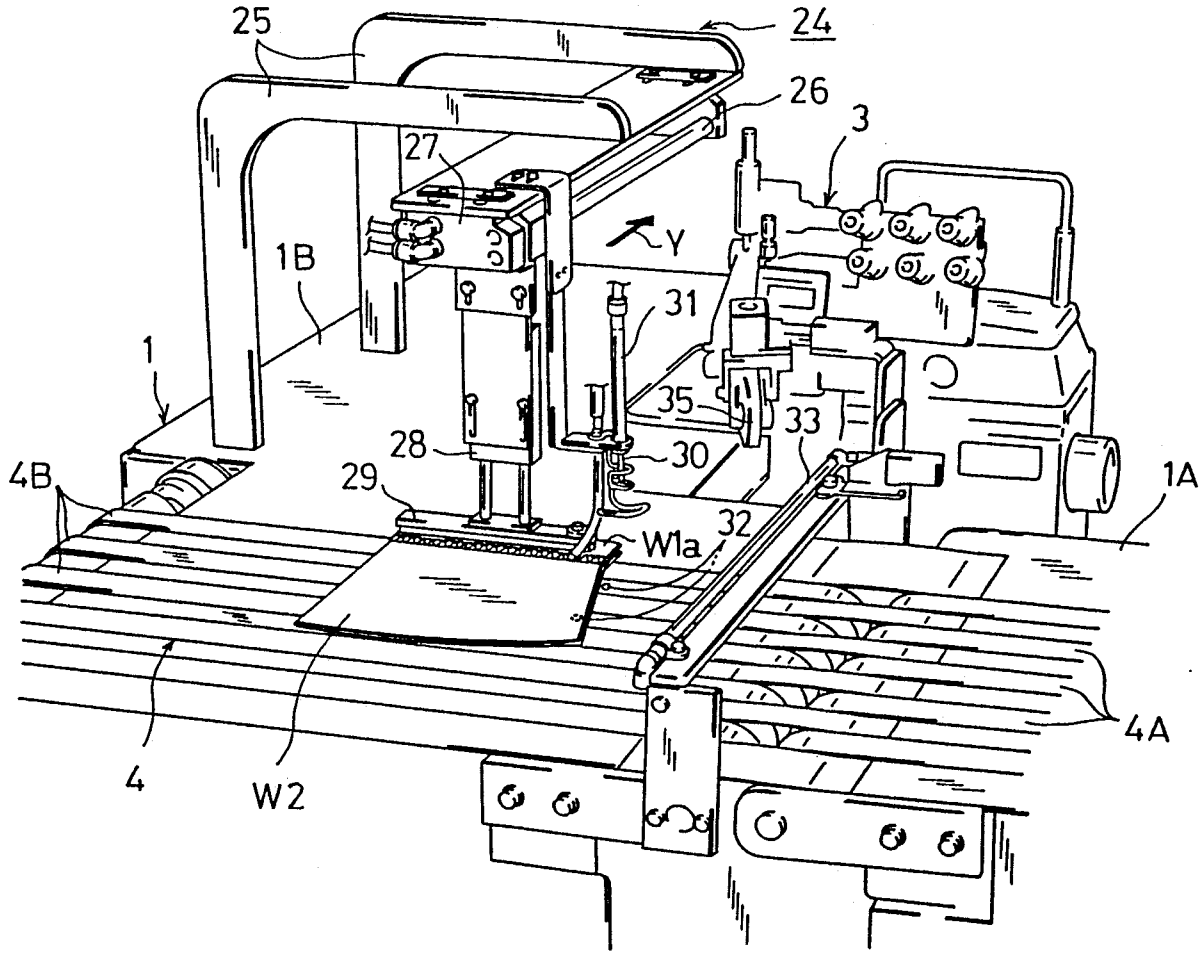
FIG. 6 is a perspective view of essential parts showing the structure and operation of a deflected piece transfer device.
Figure 7A:
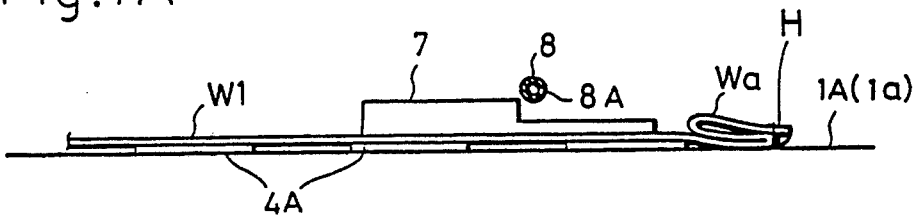
FIG. 7A to FIG. 7D are longitudinal front views of essential parts sequentially showing the operation for flattening and extending the hemmed piece.
Figure 7B:
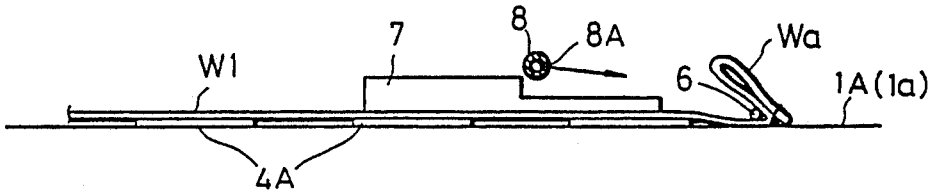
Figure 7C:
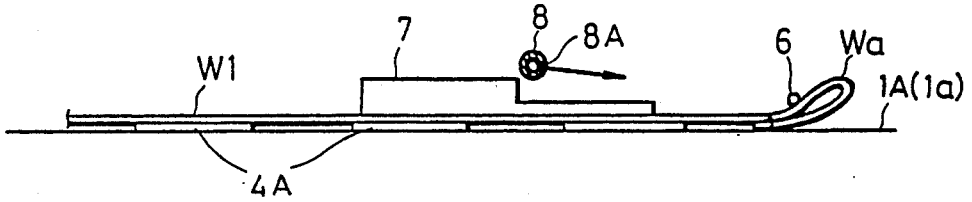
Figure 7D:
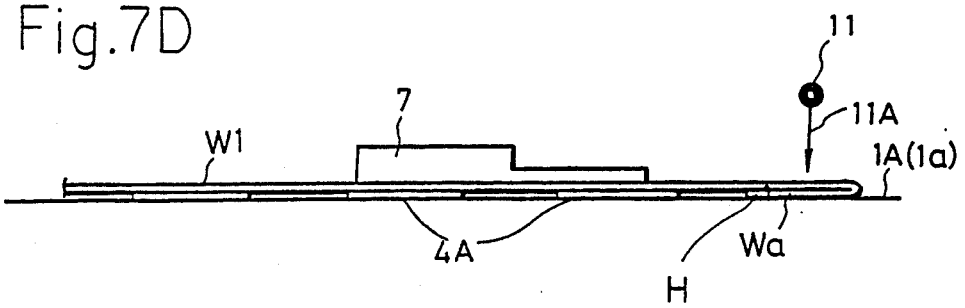

The deflected piece W2 thus folded in two is sent out, as shown in FIG. 6, onto the second conveyor belts 4B from the first conveyor belts 4A. The second conveyor belts 4B are constructed so as to be driven independently of the first conveyor belts 4A in order to match with the sewing timing of the second sewing machine 3.

A transfer device 24 transfers the deflected piece W2 (FIG. 6) conveyed by the second conveyor belts 4B in a direction orthogonal to the feeding direction of the second conveyor belts 4B along the top surface of the table part 1B of the second sewing machine 3 side, and the feeding edges of the deflected piece W2 to the second sewing machine 3. The tranfer device 24 comprises a movable frame 27 supported free to reciprocally move linearly in the direction orthogonal to the feed direction of the second conveyor belt 4B along a guide rail 26 set up on the upper part of the table part 1B. Also included is L-arm 25, and a transfer member 29 in plate form for pressing the edge parts W1*a* along the hemming line H of the deflected piece W2 against the mounting plane 1*a* of the table 1 in the lowering state the lower end being elevatably supported on the movable frame 27 with a cylinder 28 mounted in the vertical position. In the vicinity of the transfer device 24, a spot pressing member 30 is disposed for pressing a part near the rear end of the edge W1*a* being conveyed by the second conveyor belt 4B against the table 1. The spot pressing member 30 is disposed free to move vertically through a pen cylinder 31, while a third sensor 32 is disposed between and under the second conveyor belts 4B for detecting whether the edge part W1*a* has come onto the sewing line of the second sewing machine 3, and the deflected piece W2 is supplied to the second sewing machine 3 by adjusting its position and direction.

Consequently, when the deflected piece W2 conveyed by the second conveyor belt 4B comes to the specified position and direction, the plate-shaped transfer member 29 at the lower end of the movable frame 27 presses through the cylinder 28 the edge part W1*a* along the hemming line H against the mounting plane 1*a* of the table 1. In succession, the movable frame 27 linearly moves in a direction orthogonal to the feed direction of the second conveyor belts 4B along the guide rail 26, and by so moving the deflected piece W2 is transferred along the upper surface of the table part 1B of the second sewing machine 3 side to be sewn, thereby fabricating a tubular sleeve.

If, meanwhile, the sewing line W1*b* of the deflected piece W2 to be sewn by the second sewing machine 3 is bent on the way, a direction changing member 35 may be disposed before the second sewing machine 3 so as to change direction in the midst of sewing, or when the sewing line W1*b* of the deflected piece W2 is nearly linear, its direction may be converted by the cooperation of the spot pressing member 30 lowered by the pen cylinder 31 and the second conveyor belt 4B. In FIG. 6, moreover, an air blow pipe 33 is provided for flattening the deflected piece W2, and in FIG. 1, a stacker device 34 is shown for stacking up a plurality of sleeves fabricated in a tubular form and discharging outside as one lot.

The operation of the automatic sewing apparatus for hemming and closing sleeve composed in this way will now be explained. The individual operations have been explained in detail above together with the arrangement, and the overall operation is mainly described below in the sequence of steps.

When the sleeve blank W is put on the first conveyor belt 4A of the blank feed device 4 on the same plane as the table part 1A of the sewing machine table 1, with an edge running along the fitting guide 9 on the conveying surface, the sleeve blank W is conveyed in the direction indicated by the arrow X by the conveyor belts 4A. In the process of this conveying, in the first place, the edge of the blank W is folded in an S-form by the folding device 5, and is supplied from its front end into the first sewing machine 2, and is hemmed along the folding line.

In succession, the S-formed folding part Wa of the hemmed piece W1 sent out from the first sewing machine 2 is conveyed, is simultaneously flattened and developed by the flattening tool 6 and the air blown out of the nozzle holes 8A, 11A sequentially, and is supplied to the deflecting device 12.

When the first sensor 19 detects that the front end of the hemmed piece W1 conveyed by the conveyor belts 4A toward the deflecting device 12 has reached the specified position, by the action of the cylinder 15 on the basis of the detected signal from the sensor 19, the clamp 16 holds the front end part of the hemmed piece W1, and by the action of the air cylinder 17, the clamp 16 and the front end part of the hemmed piece W1 are lifted upward from the conveying surface of the conveyor belts 4A to be stopped in the state shown in FIG. 4. In this state, when the rear end of the hemmed piece W1 conveyed by the conveyor belt 4A reaches the specified position, the second sensor 20 issues a signal indicating the absence of the hemmed piece W1, and by the action of the cylinder 15 according to the signal of the second blank sensor 20, the clamp 16 clears the holding of the front end part of the hemmed piece W1. As a result, the front end portion of the hemmed piece W1 drops spontaneously on the rear end portion thereof, and the piece W1 is deflected in half as shown in FIG. 5 as being folded along the line orthogonal to the hemming line H. The deflected piece W2 is then sent out by the conveyor belt 4A, and the clamp 16 of the deflecting device 12 is lowered, thereby returning to the waiting state for the next hemmed piece W1.

In succession, the deflected piece W2 carried out from the deflecting device 12 is flattened by the air blown out from the air blow pipe 33, and when it passes through the specified position, according to the detected signal from the third sensor 32, is stopped in the specified position and specified direction, and the plate-shaped blank transfer member 29 at the lower end part of the movable frame 27 presses the edge part W1*a* along the hemming line H of the deflected piece W2 against the blank mounting plane 1*a* of the table 1.

Sequentially, the movable frame 27 moves linearly in the direction orthogonal to the feeding direction of the second conveyor belts 4B as indicated by the arrow Y in FIG. 6 along the guide rail 26, and by this movement the deflected piece W2 is transferred along the upper surface of the table part 1B of the second sewing machine 3, and its piled edges are supplied to the second sewing machine 3 and sewn together, thereby fabricating a tubular sleeve. The thus fabricated sleeve is sent into the stacker device 34, and formed into a laminated plurality. The laminated plurality of sleeves are discharged outside as one lot.

In this way, by putting sequentially the sleeve blanks W on the conveying surface of the blank feed device 4 at a specified position at one end of the sewing machine table 1, the sleeve making processes of S-form folding, hemming by the first sewing machine 2, flattening and development of the S-form folding, folding in half, and sewing of the deflected piece W2 is done fully automatically and continuously, thereby saving labor, enhancing productivity, and saving space of the entire apparatus.

In particular, the front end portion of the hemmed piece W1 conveyed on the plurality of conveyor belts 4A of the blank feed device 4 is held by the clamp 16 which operates by receiving a detection signal from the first sensor 19, and by lifting the holding point, with the holding point being stopped, the rear end portion of the hemmed piece W1 is conveyed by the conveyor belts 4A, and only by releasing the clamp 16 on receiving a signal from the second sensor 20 when the rear end portion reaches a specified position, the hemmed piece W1 is folded in two in the horizontal plane, and therefore as compared with the case of picking up the entire hemmed piece or folding in two on the vertical plane by pushing it up from beneath, the specified deflecting function may be done more securely and accurately regardless of the material or characteristic of the blank W.

In the foregoing embodiment, meanwhile, the transfer device 24, for pressing the edge of the deflected piece W2 folded in half against the table surface, comprises the plate-shaped transfer member 29 so as to be free to move linearly, but it is not so limited so that it may be moved, for example, by the conveyor belts. As the flattening tool 6, a plate shape may be also used.

What is claimed is:

1. A sewing apparatus for forming a tubular sleeve by hemming and closing a sleeve blank, said sleeve blank having an opening side defining an edge, and a lower surface, the apparatus comprising:

a sewing table having an L-shaped sleeve blank upper mounting surface, said sewing table defining a first inner corner side and a second inner corner side;

a first sewing machine for hemming the sleeve blank along a hemming line, said first sewing machine being installed on the sewing table at the first inner corner side thereof and defining a delivery side;

a feed device having a conveying surface on a same plane as the sewing table;

a folding device for folding back the edge of the opening side of the sleeve blank onto the lower surface of the sleeve blank along a direction of movement of the sleeve blank on the sewing table to form a hemmed piece, said folding device being installed on the conveying surface of the feed device before the first sewing machine;

at least one sensor for detecting the hemmed piece on the conveying surface;

a deflecting device for folding the hemmed piece in halves along a line orthogonal to the hemming line, said deflecting device having an elevating member and a clamping member and being installed at the delivery side of the first sewing machine;

a second sewing machine for closing the folded hemmed piece, said second sewing machine being installed at said second inner corner side of the sewing table; and a transfer device for transferring the folded hemmed piece in a direction orthogonal to the direction of movement along the upper surface of the sewing table toward the second sewing machine, wherein said feed device comprises a plurality of first conveyor belts disposed parallel and at intervals in the direction orthogonal to the direction of movement of the sleeve blank before and after said first sewing machine, said plurality of first conveyor belts defining a conveyor end part, and a plurality of second conveyor belts disposed parallel and in the same direction of movement, said second conveyor belts having a conveying surface flush with the conveying surface of said first conveyor belts and being contiguous to said conveying end part of said first conveyor belts, said first and second conveyor belts being driven independently of each other so as to be mutually matched with the sewing timing of said first and second sewing machines; and wherein the clamping member grips the front end of the hemmed piece, raises it to an upper position from the conveying surface in response to a first signal from said sensor thereby stopping movement of the front end of said hemmed piece, and release the front end to drop onto the rear end of the hemmed piece in response to a second signal from said sensor in order to fold the hemmed piece in halves, said hemmed and folded piece being transferred by said transfer device to said second sewing machine which sews together the front and rear edges thereof.

2. The sewing apparatus for hemming and closing a sleeve blank according to claim 1, wherein said transfer device comprises a movable frame freely movable linearly in a direction orthogonal to the direction of movement of the sleeve feed blank along a guide rail disposed above the sleeve blank upper mounting surface of the sewing table adjacent the second sewing machine, and a transfer member in plate form for pressing an edge portion of the folded hemmed piece to the mounting surface, and wherein the pressed edge portion is elevatably supported by the movable frame.

3. The sewing apparatus for hemming and closing a sleeve blank according to claim 1, wherein the clamping member of said deflecting device has plural pairs of tongues opening and closing vertically toward the upstream side of the plurality of said first conveyor belts disposed in adjacent interval of said first conveyor belts, which hold a front end portion of the hemmed piece conveyed on the conveyor belts, and wherein said sewing apparatus further comprises a driving mechanism for elevating and lowering the clamping member, and a sensor for detecting when a rear end portion of the hemmed piece reaches a specified position, said sensor issuing a signal indication that the specified position has been reached.

4. A sewing apparatus for forming a tubular sleeve by hemming and closing a sleeve blank, said sleeve blank having an opening side defining an edge, and a lower surface, the apparatus comprising:

a sewing table having a sleeve blank upper mounting surface;

a sewing machine for hemming the sleeve blank along a hemming line, said sewing machine being installed on the sewing table along a side thereof and defining a delivery side;

a feed device having a conveying surface on a same plane as the sewing table and comprising a plurality of conveyor belts disposed parallel and at intervals in the direction orthogonal to the direction of movement of the sleeve blank;

a folding device for folding back the edge of the opening side of the sleeve blank onto the lower surface of the sleeve blank along a direction of movement of the sleeve blank on the sewing table to form a hemmed piece, said folding device being installed on the conveying surface of the feed device before the sewing machine;

at least one sensor for detecting the hemmed piece on the conveying surface; and a deflecting device for folding the hemmed piece in halves along a line orthogonal to the hemming line, said deflecting device having an elevating member and a clamping member and being installed at the delivery side of the sewing machine, said clamping member having a plurality of clamps in each adjacent interval of the conveyor belts, wherein the clamping member grips the front end of the hemmed piece, raises it to an upper position from the conveying surface in response to a first signal from said sensor thereby stopping movement of the front end of said hemmed piece, and releases the front end to drop onto the rear end of the hemmed piece in response to a second signal from said sensor in order to fold the hemmed piece in halves.

* * * * *

UNITED STATES PATENT AND TRADEMARK OFFICE

CERTIFICATE OF CORRECTION

PATENT NO. : 5,257,591

DATED : November 2, 1993

INVENTOR(S) : Yukinori Suzuki et al

It is certified that error appears in the above-identified patent and that said Letters Patent is hereby corrected as shown below:

Claim 1, column 9, line 7, "release" should be "releases".

Signed and Sealed this

Third Day of May, 1994

Bruce Lehman

*Attest:*

BRUCE LEHMAN

*Attesting Officer*

*Commissioner of Patents and Trademarks*